US008011402B1

(12) United States Patent
Gaffney

(10) Patent No.: US 8,011,402 B1
(45) **Date of Patent: *Sep. 6, 2011**

(54) GOLF CLUB HEAD COVER AND TOWEL

(75) Inventor: John H. Gaffney, Tempe, AZ (US)

(73) Assignee: Arizona Manufacturing & Embroidery, Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/325,957

(22) Filed: Dec. 1, 2008

Related U.S. Application Data

(63) Continuation of application No. 11/490,724, filed on Jul. 20, 2006, now Pat. No. 7,458,405.

(51) Int. Cl.
*A63B 57/00* (2006.01)

(52) U.S. Cl. ..... 150/160; 206/315.4; 15/209.1

(58) Field of Classification Search ..... 150/159, 150/160; 206/315.2, 315.4; 15/209.1
See application file for complete search history.

(56) References Cited

U.S. PATENT DOCUMENTS

| | | | | |
|---|---|---|---|---|
| 3,128,812 | A | 4/1964 | Scheurer | |
| 3,638,284 | A | 2/1972 | Baker | |
| 3,831,652 | A | 8/1974 | Hyden | |
| 3,938,570 | A | 2/1976 | Stewart | |
| 4,898,222 | A | 2/1990 | Gaffney | |
| 4,912,800 | A | 4/1990 | Zeltner | |
| 5,075,918 | A * | 12/1991 | Zeltner et al. | 15/210.1 |
| 5,099,897 | A * | 3/1992 | Curtin | 150/159 |
| 5,215,136 | A | 6/1993 | Flanders | |
| 5,280,798 | A | 1/1994 | Helm | |
| 5,394,914 | A | 3/1995 | Meek | |
| 5,407,723 | A | 4/1995 | Curtin | |
| 5,771,523 | A | 6/1998 | Rudolph | |
| 5,816,396 | A | 10/1998 | Shin | |
| 5,898,968 | A * | 5/1999 | Beattie | 15/210.1 |
| 6,138,727 | A | 10/2000 | Shih | |
| 6,463,971 | B1 | 10/2002 | Kinsey | |
| 6,560,812 | B1 * | 5/2003 | Pettway | 15/210.1 |
| 7,458,405 | B1 * | 12/2008 | Gaffney | 150/160 |
| 2003/0056866 | A1 * | 3/2003 | Sheppard, Jr. | 150/160 |
| 2004/0144460 | A1 * | 7/2004 | German | 150/160 |
| 2006/0037163 | A1 * | 2/2006 | Steinway | 15/209.1 |
| 2007/0068611 | A1 * | 3/2007 | Hwang | 150/160 |
| 2007/0068612 | A1 * | 3/2007 | Potter | 150/160 |
| 2007/0094826 | A1 | 5/2007 | Chandler et al. | |

FOREIGN PATENT DOCUMENTS

| | | | |
|---|---|---|---|
| CA | 2393163 | A1 * | 1/2004 |
| EP | 1287859 | A1 | 3/2003 |
| JP | 2005253923 | | 9/2005 |

* cited by examiner

*Primary Examiner* — Sue A Weaver
(74) *Attorney, Agent, or Firm* — Booth Udall, PLC

(57) ABSTRACT

A golf club head cover and towel assembly comprises a head cover having a toe end and a heel end. The heel end comprises an opening thereon, and the opening is positionable between an open position and a closed position. A towel removably coupled with the opening is provided.

5 Claims, 4 Drawing Sheets

GOLF CLUB HEAD COVER AND TOWEL

CROSS REFERENCE TO RELATED APPLICATIONS

This application is a continuation of the earlier patent entitled "Golf Club Head Cover and Towel," Ser. No. 11/490,724, filed Jul. 20, 2006, now U.S. Pat. No. 7,458,405, the disclosure of which is hereby incorporated herein by reference.

BACKGROUND

The invention illustrated in the enclosed embodiment of this application relates to head covers for golf clubs, and more particularly, to a combination of a head cover and a towel. Golf club head covers currently are extensively used to protect the golf club heads during transport and storage, and at all times until the particular club is used in conjunction with the play of a game of golf. Covers are especially used for putters because of the relatively high cost of putters and the desire to protect the face of the putter from scratches and nicks.

A putter cover which has been found to be particularly handy for use, because of its ease of placement and removal, is the putter cover of applicant's U.S. Pat. No. 4,898,222. This putter cover has an open back on it with matching hook-and-loop strips on opposite sides, which allow the putter cover to be closed over the shaft of the putter club when the club is placed in the bag for storage. Removal of the cover of U.S. Pat. No. 4,898,222 is readily effected by pulling apart the attached hook-and-loop strips, either by pulling on opposite sides of the cover adjacent the strips, or by simply pulling the cover forward over the toe of the putter to cause the heel and the shaft to open the hook-and-loop strips, effectively opening and removing the putter cover in one continuous motion.

Another important accessory used in the play of the game of golf is a small towel or wiper, typically in the form of terry cloth or other absorbent material for use in cleaning a club head or putter club head and the golf ball. Such towels also are used by the golfer to clean perspiration from his or her hands prior to using a golf club or putter. Golfers frequently place a towel in a pocket of their wearing apparel; but some golf apparel does not have pockets for carrying a towel. In such a case, the towel must be carried separately in some other way. Fasteners have been provided on the golf bag or on the golf cart for temporarily and releasably holding a towel; but such locations are not entirely convenient.

A number of patents have been granted for combinations of a putter head cover and a towel. Generally, the configuration of the combined towel/head cover is such that the resultant basically is a specially shaped towel, which, when not in use, also surrounds or covers the putter head. Obviously, when such a combination towel/putter head cover becomes soiled and in need of laundering, the entire putter head cover/towel combination must be removed from the putter to effect the necessary laundering. This leaves the putter head unprotected during whatever time is required for laundering. Such combination putter cover/towels, however, do have an advantage in that the towel is associated with the most frequently used club in the bag of golf clubs. It is desirable to provide a combination of a towel and a putter head cover which overcomes the disadvantages of the prior art noted above.

DETAILED DESCRIPTION

Figure 1:
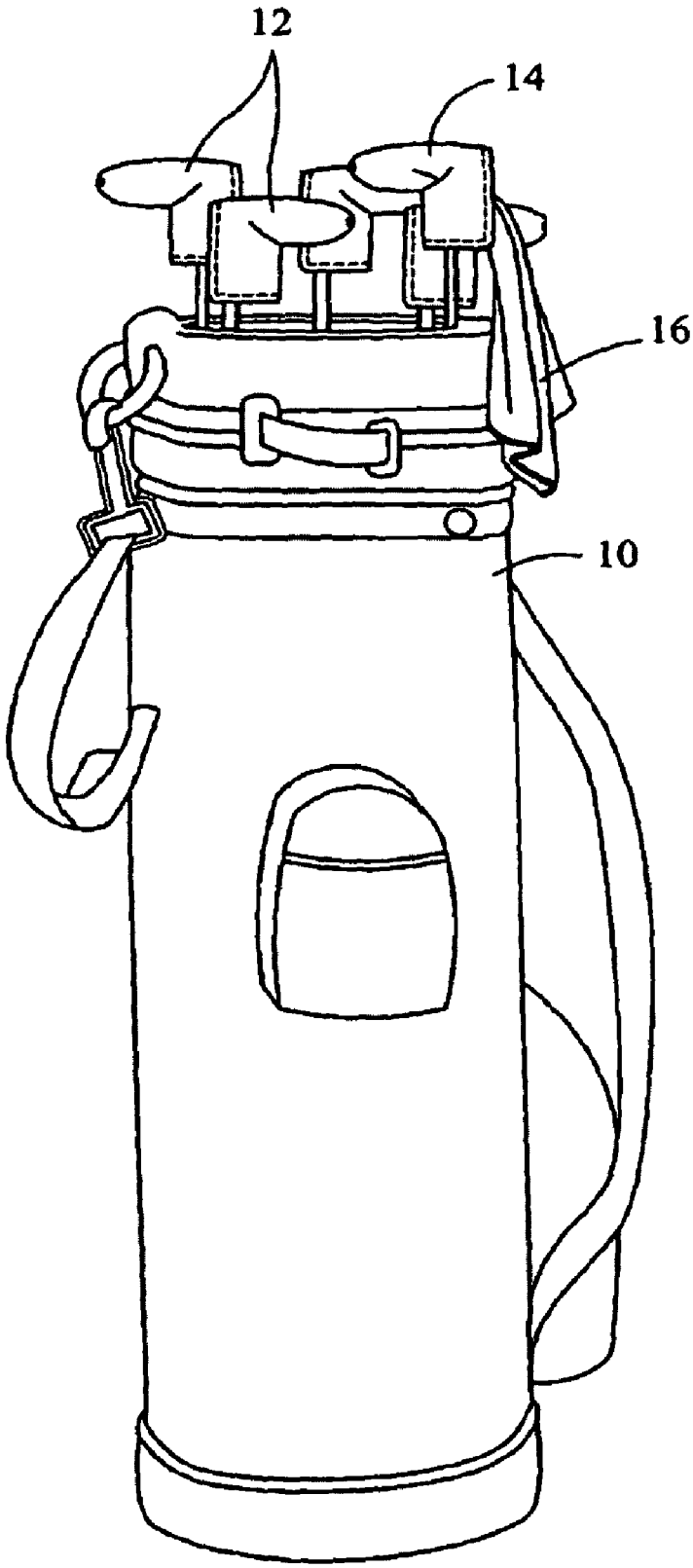
FIG. 1 is a side view of a golf bag showing an embodiment of the invention on a club stored in the bag.

Reference now should be made to the drawings, in which the same reference numbers are used throughout the different figures to designate the same or similar components. FIG. 1 shows a typical golf bag 10, which may be used to store a number of different golf clubs, each shown in FIG. 1 as covered by head covers 12 and 14. FIG. 1 also shows a wiper or towel 16 which is releasably attached to the head cover 14, illustrated in the remainder of the figures as a putter head cover.

Figure 2:
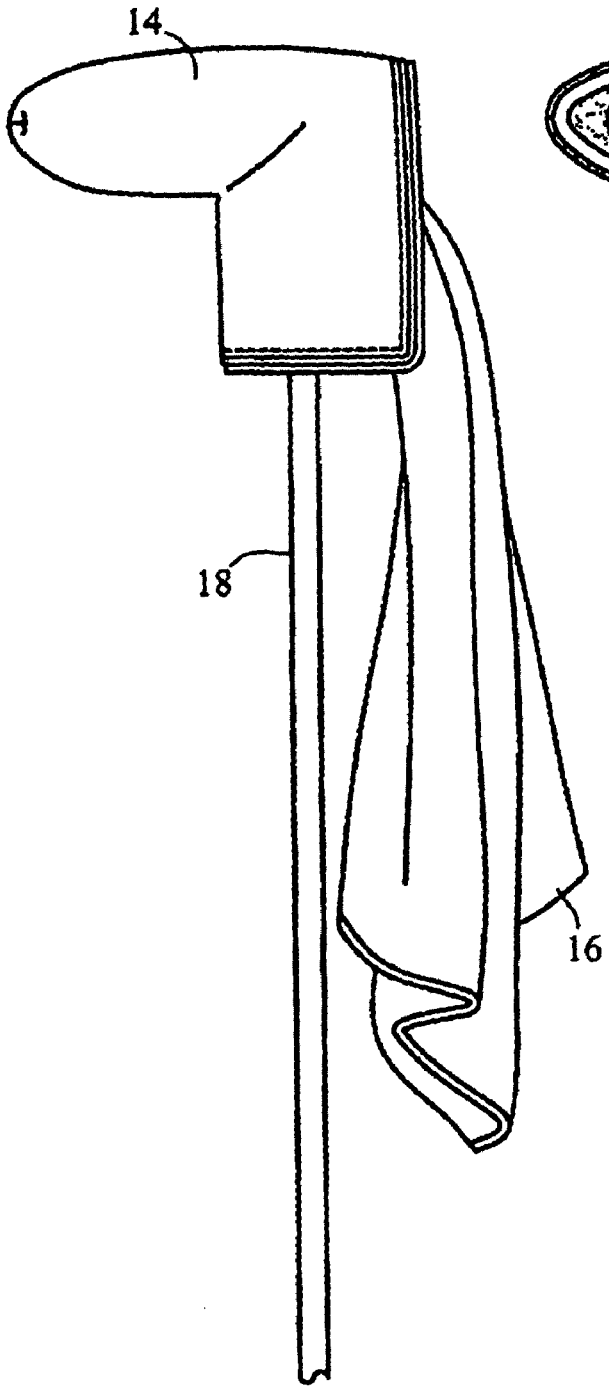
FIG. 2 is an enlarged side view of an embodiment of the invention.

FIG. 2 is a side view of the putter head cover 14 placed over and surrounding a putter head, with the shaft 18 of the putter extending outwardly from the cover 14.

Figure 4:
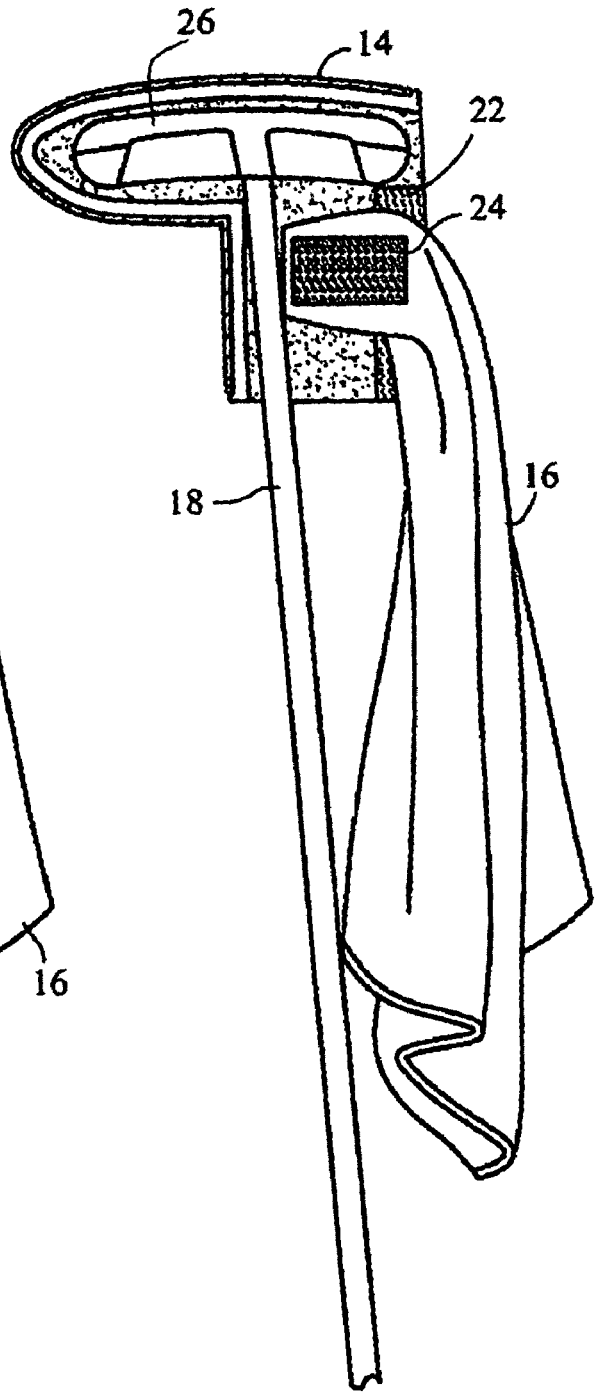
FIG. 4 is a cross-sectional view taken along the line 4-4 of FIG. 3.
Figure 3:
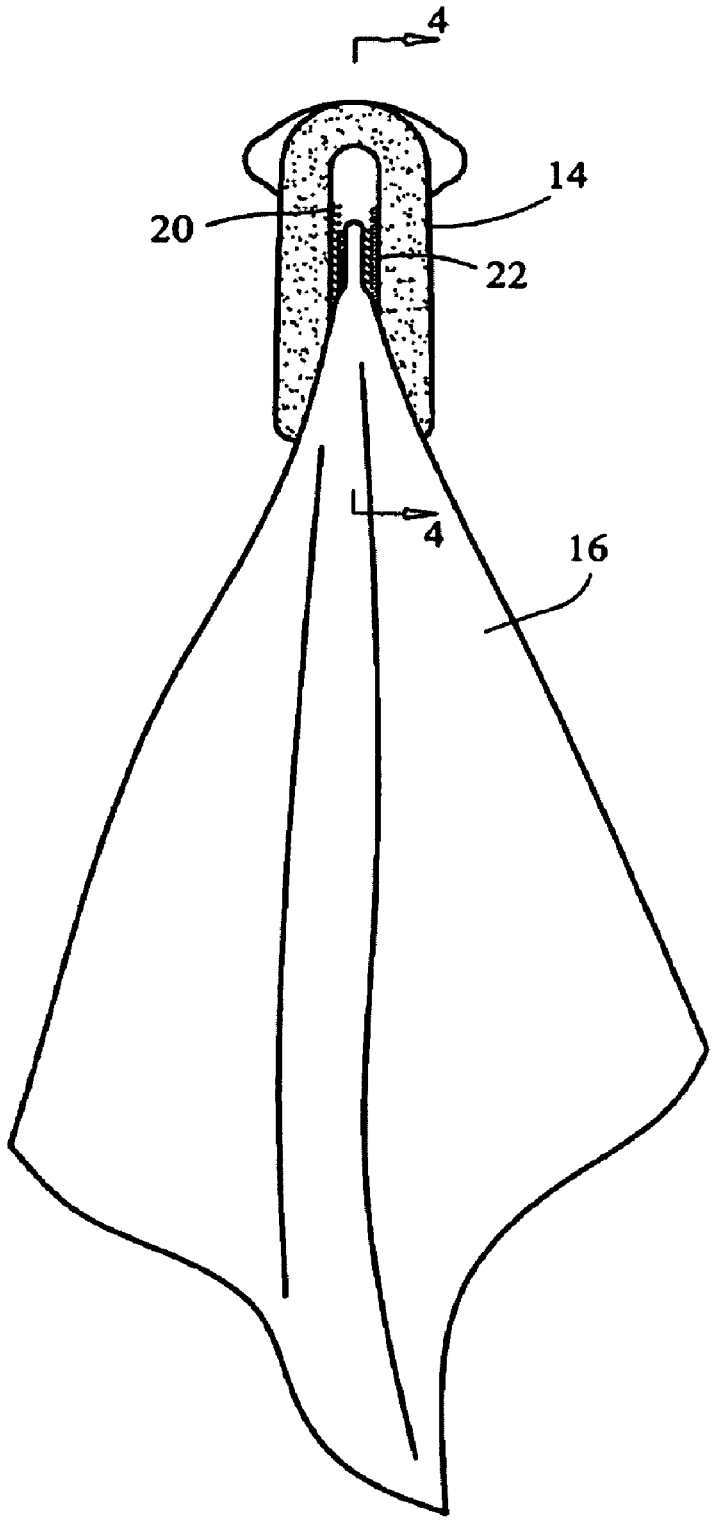
FIG. 3 is a rear view of the embodiment shown in FIG. 2.

The cover 14 ideally is made in the configuration of the putter head cover of U.S. Pat. No. 4,898,222, the specification of which is incorporated herein by reference, in its entirety. FIGS. 3 and 4 show additional details of the head cover 14, which is open along its back or "heel" edge from the bottom of the putter head, such as the head 26 shown in FIG. 4, and extending upwardly a short distance along the shaft 18.

As noted in U.S. Pat. No. 4,898,222, the head cover 14 has a pair of elongated mating hook-and-loop fastener strips such as VELCRO® strips 20 and 22 located on opposite facing sides of the open back. When the head cover 14 is secured onto a putter head 26, such as shown in FIGS. 1 and 2, the mating strips 20 and 22 engage one another to releasably hold the putter cover 14 in place on the putter head. Pulling open the strips 20 and 22 to disengage them opens the back of the putter cover 14 to allow removal of the putter 26 and the shaft 18 from the cover 14, which then may be placed aside during the time the putter is used by the golfer.

Figure 5:
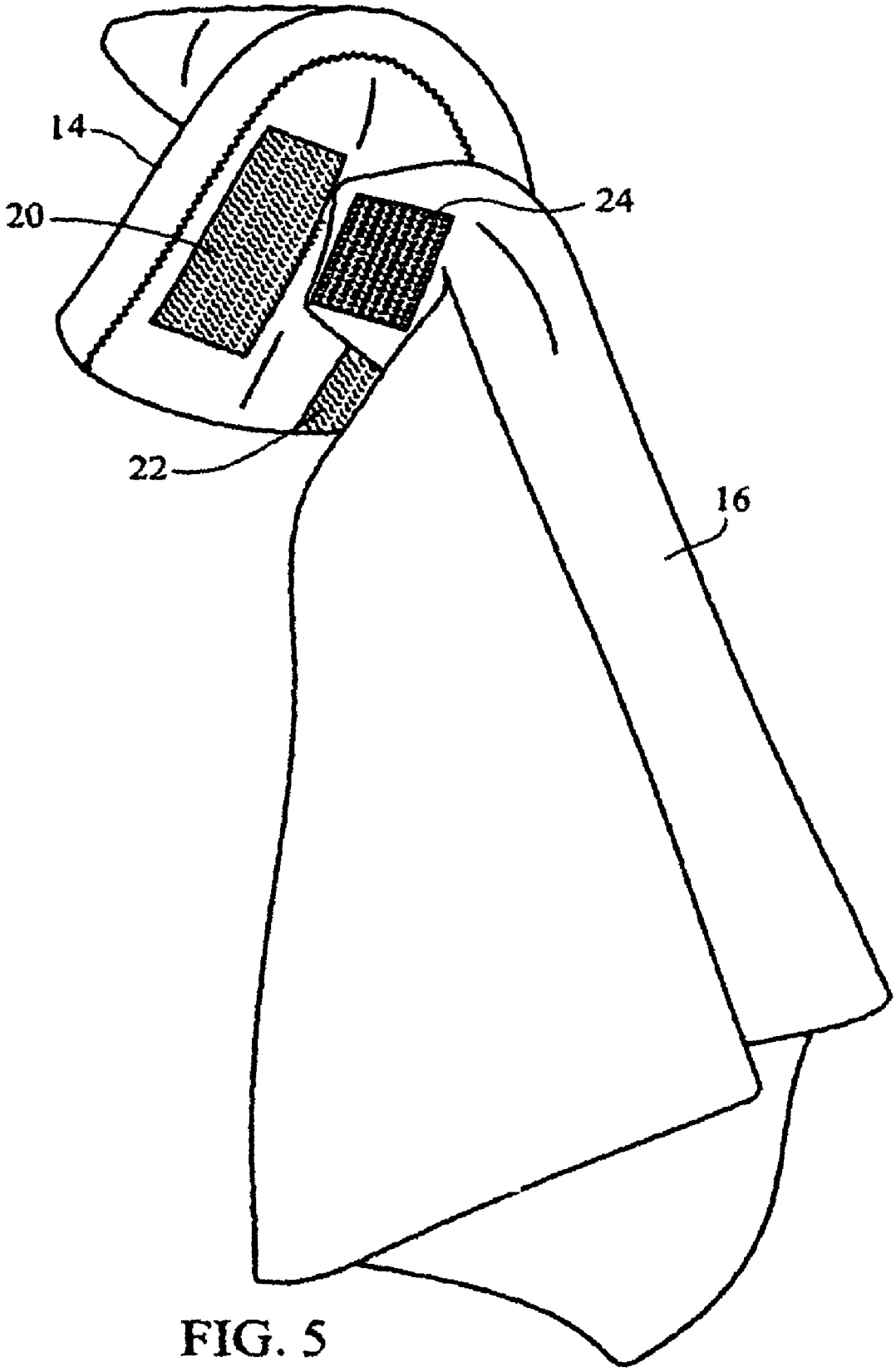
FIG. 5 is a perspective view illustrating features of the embodiment of FIGS. 2, 3 and 4.

As illustrated in FIGS. 3, 4 and 5 in particular, the putter cover of U.S. Pat. No. 4,898,222 is used to also releasably hold a terry towel or other suitable absorbent wiper 16 in position for ready access, as illustrated in FIG. 1. This is accomplished by placing a small square of universal hook-and-loop fastener 24 on the opposite sides of a corner of the towel 16. This corner of the towel with the universal hook-and-loop fastener 24 on each side of the towel then is placed between a portion of the mating strips 20 and 22, and engages one or both of those strips to hold the towel 16 in place on the putter cover as shown in FIGS. 3 and 4. The portions of the strips 20 and 22, which do not engage the smaller squares 24 engage one another, holding the remainder of the putter cover-on the putter head 26 and shaft 18 in the manner described in U.S. Pat. No. 4,898,222.

FIG. 4 is a cross section which has removed the side of the putter cover 14 carrying the strip 20 on it to indicate a possible positioning of the strip 24 and the towel 16 on the putter cover 14, along with the shaft 18 and the putter head 26. Even with one side removed, such as the side carrying the hook or loop strips 20, the opposing fastener square 24 on the opposite side of the towel 16 from that shown in FIG. 4 engages and is held by the other fastener strip 22. Typically, when the putter cover 14 is opened, the towel 16 remains attached to one or the other of the strips 20 and 22, from which it readily can also be removed, if desired. It is not necessary, however, to remove the towel 16 entirely from the putter cover 14 in order to use it, once the putter cover 14 has been removed from the putter, as described above.

FIG. 5 is a partial perspective view showing the putter cover 14 opened, with the putter 26 removed to show the exposed one of the hook-and-Loop fastener elements 20 disengaged from the universal hook/loop square 24 on the corner of the towel 16. The mating fastener 22 on the rear edge of the putter cover 14 is shown partially exposed in FIG. 5; and the square of universal hook/loop fastener 24 on the opposite side of the towel 16 (not shown in FIG. 5) remains attached to the fastener portion 22 on the putter cover.

When the towel 16 is to be laundered, it readily can be disengaged from the releasable hook-and-loop fastener elements 20 and 22, leaving the putter cover 14 in place on the putter head 26. Alternatively, a second towel 16 immediately may be used to replace one which has been removed for laundering.

The foregoing description of an embodiment of the invention is to be considered as illustrative and not as limiting. For example, although hook-and-loop fastener elements are described in conjunction with the portions 20, 22 and 24, other fasteners, such as snap fasteners, magnetic fasteners, or the like could be used to effect the same functional operation. Various other changes and modifications will occur to those skilled in the art for performing substantially the same function, in substantially the same way, to achieve substantially the same result, without departing from the true scope of the invention as defined in the appended claims.

The invention claimed is:

1. A golf club head cover and towel assembly comprising:

a head cover comprising a first body portion made of flexible material and shaped to encase a golf club head having a toe and heel, the first body portion having a toe end and a heel end and being open on the heel end thereof; a second body portion of the head cover having first and second ends, with the first end thereof attached to the first body portion at the heel end thereof and substantially at right angles thereto for encasing at least a portion of the shaft of a golf club where the shaft is attached to the head, the second body portion being open on the second end and open on the side thereof adjacent the opening in the first body portion to form a single continuous opening within the head cover; first and second mating fasteners located, respectively, on opposite sides of the inside of the second body portion adjacent the opening on the side thereof; and a towel member having a third mating fastener thereon adjacent an edge of the towel member for releasable engagement with a portion of at least one of the first and second mating fasteners to releasably hold the towel member on the head cover when the head cover is on the head of a golf club and when the head cover is removed from the head of a golf club.

2. The assembly of claim 1, wherein the first mating fastener and the second mating fastener comprise hook-and-loop fasteners.

3. The assembly of claim 1, wherein the first mating fastener and the second mating fastener comprise matching hook-and-loop strips.

4. The assembly of claim 1, wherein the towel is rectangular and the third mating fastener is located adjacent a corner of the towel member.

5. The assembly of claim 1, wherein the third mating fastener comprises hook-and-loop fastener members for engaging one of the first mating fastener and the second mating fastener.

* * * * *